US006115968A

United States Patent [19]

Sarlanis

[11] Patent Number: 6,115,968

[45] Date of Patent: Sep. 12, 2000

[54] SUSPENSION SYSTEM FOR SLIDING DOORS WITH A HEIGHT AND INCLINATION ADJUSTING MECHANISM

[76] Inventor: Evagelos Sarlanis, 7 Filikis Eterias Street, Koridalos, GR-181 20 Athen, Greece

[21] Appl. No.: 09/171,225

[22] PCT Filed: Apr. 10, 1997

[86] PCT No.: PCT/GR97/00011

§ 371 Date: Dec. 28, 1998

§ 102(e) Date: Dec. 28, 1998

[87] PCT Pub. No.: WO97/38198

PCT Pub. Date: Oct. 16, 1997

[30] Foreign Application Priority Data

Apr. 11, 1996 [GR] Greece ..... 960100122

[51] Int. Cl.[7] ..... E05D 13/00

[52] U.S. Cl. ..... 49/409; 16/105

[58] Field of Search ..... 49/409, 148, 226, 49/228, 231; 16/99, 87 R, 105

[56] References Cited

U.S. PATENT DOCUMENTS

| | | | |
|---|---|---|---|
| 3,118,170 | 1/1964 | Zollinger | 16/105 |
| 3,156,020 | 11/1964 | Horgan | 49/409 |
| 3,193,871 | 7/1965 | Foltz | 16/105 |
| 3,744,827 | 7/1973 | Cox | 49/409 X |
| 5,845,363 | 12/1998 | Brempell et al. | 16/99 X |

FOREIGN PATENT DOCUMENTS

| | | | |
|---|---|---|---|
| 47806 | 6/1978 | U.S.S.R. | 49/226 |
| 48209 | 9/1982 | U.S.S.R. | 49/409 |

*Primary Examiner*—Jerry Redman
*Attorney, Agent, or Firm*—Flynn, Thiel, Boutell & Tanis, P.C.

[57] ABSTRACT

A suspension system for sliding doors with a height and inclination adjusting mechanism has a mechanism support (1), a short screw (2), a long screw (2*a*), two cylinders (3, 3*a*) with a threaded bore which extends perpendicularly to their longitudinal axes, a spring steel plate (4) for limiting the longitudinal displacement of the screws (2, 2*a*), a metal plate (5) for clamping the mechanism support (1) in the section (6) of the door, a pin (7) for centering the mechanism support (1) in the section of the door, a screw (8) for the centering pin (7) and a screw (9) for connecting the mechanism support (1) to the wheel support (10). The mechanism support (1) fits into the recessed part of the section (6) of the door and is connected to the wheel support (10) by the connecting screw (9). When the screws (2, 2*a*) turn around their own axes, they shift the two cylinders (3, 3*a*) and lift the front or rear part of the clamping metal plate (5), causing the length of the connecting screw (9) and pressure spring (18) to be increased or reduced and lifting or lowering the door.

24 Claims, 5 Drawing Sheets

SUSPENSION SYSTEM FOR SLIDING DOORS WITH A HEIGHT AND INCLINATION ADJUSTING MECHANISM

FIELD OF THE INVENTION

The invention relates to a suspension system for sliding doors with a height and inclination adjusting mechanism.

BACKGROUND OF THE INVENTION

Suspension systems for sliding doors with an adjusting mechanism are indeed known. However, they are complicated, particularly in the case of uneven floors.

In these known systems, the adjustment of the height of the door was regulated by means of a guide, which was fastened either on the door frame or on the upper edge of the door.

Thus one had to unhook the door for each adjustment, adjust the door appropriately, and again suspend the door in order to see whether the desired result had been achieved. This operation did not enable simultaneous adjustment of the inclination of the door relative to the floor.

SUMMARY OF THE INVENTION

The described invention has the goal to eliminate all of these disadvantages since the invention makes it possible to regulate the elevational adjustment of the door without unhooking same. In addition this mechanism has the possibility to simultaneously regulate the inclination of the door with respect to the floor in such a manner that an exact parallelism between door and floor is guaranteed independent of the degree of unevenness of the floor.

The system consists of a mechanism support, two screws with two corresponding cylinders and a spring to limit the movement of the screws.

This suspension system for sliding doors is fastened between the door frame and the upper edge of the door, and enables the adjustment of the height and and inclination of the door relative to the floor.

BRIEF DESCRIPTION OF THE DRAWINGS

The type of use of this invention will be explained in the following listed drawings, in which.

DETAILED DESCRIPTION

Figure 1:
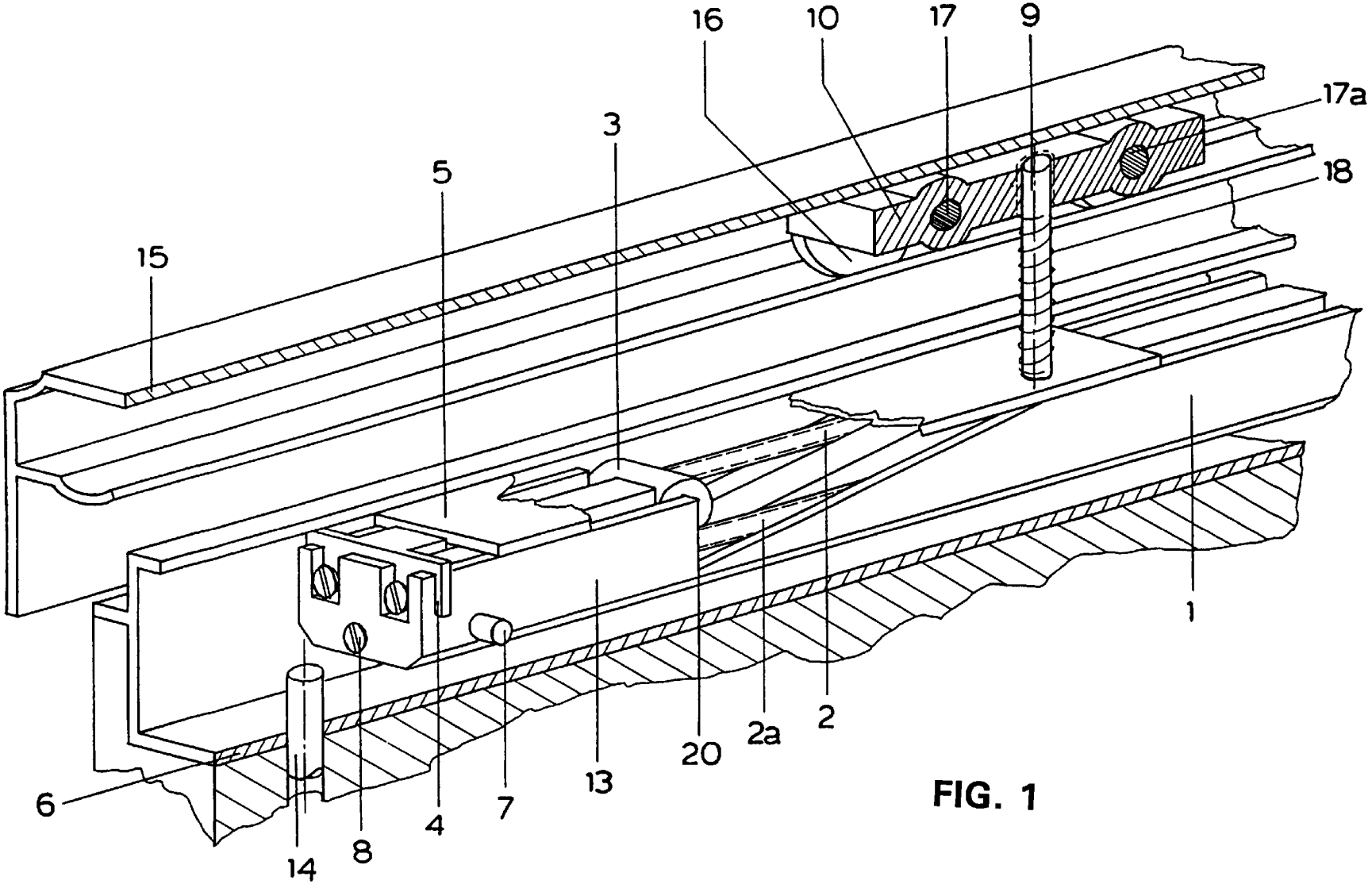
FIG. 1 is a longitudinal cross-sectional view of the front part of the suspension mechanism, in the lowermost operating position.
Figure 2:
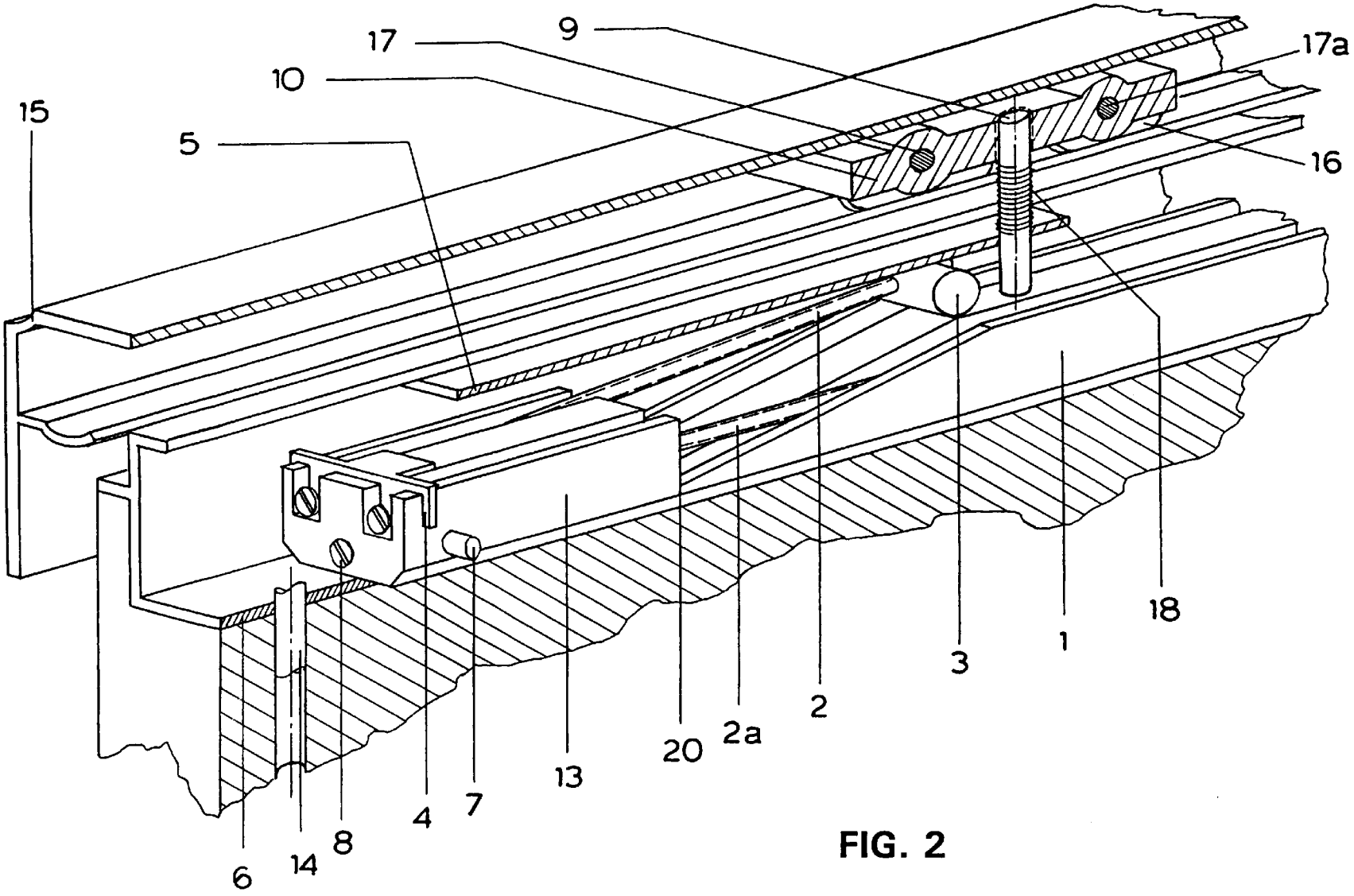
FIG. 2 is a longitudinal cross-sectional view of the front part of the suspension mechanism, in its uppermost operating position.
Figure 3:
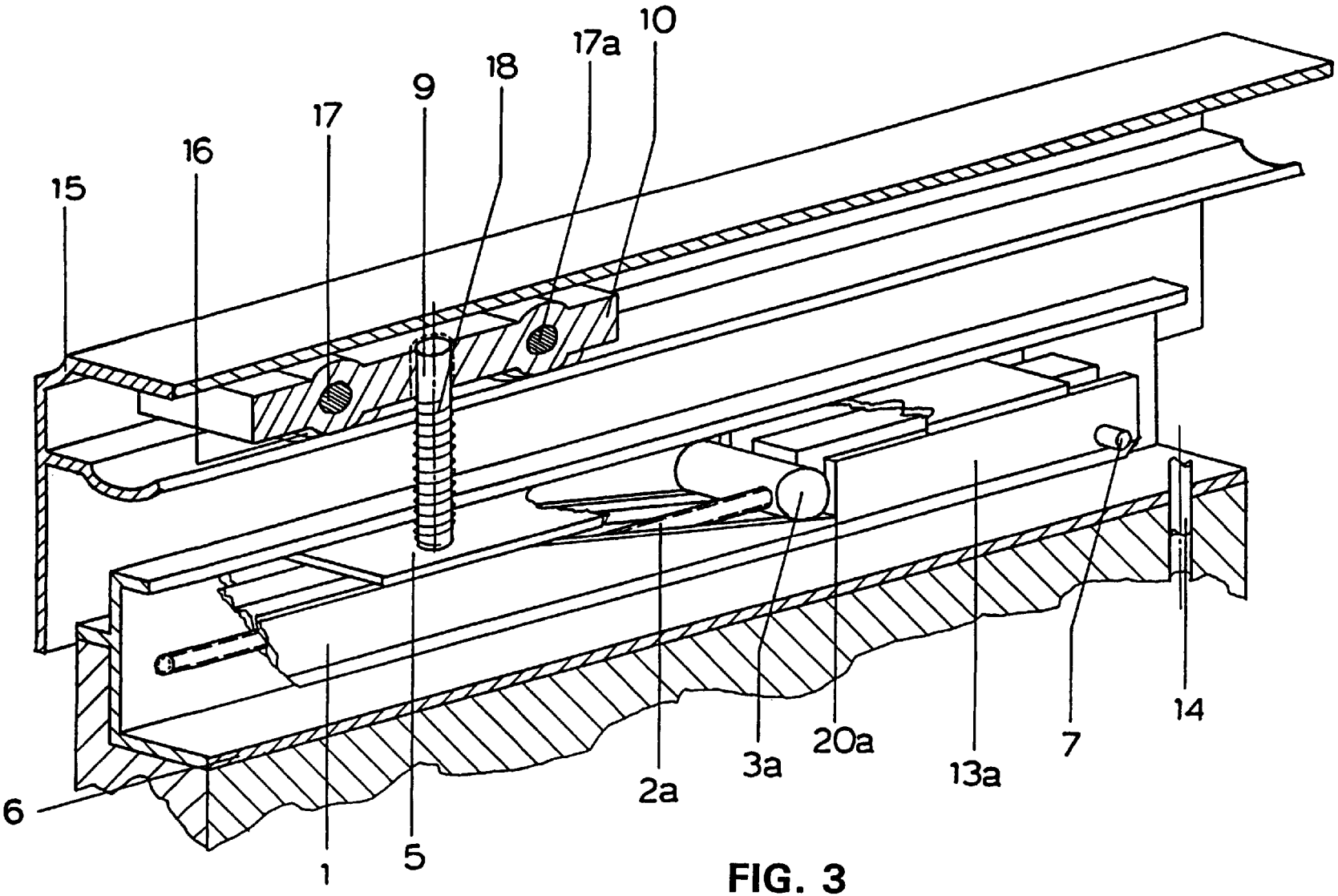
FIG. 3 is a longitudinal cross-sectional view of the rear part of the suspension mechanism, in its lowermost operating position.
Figure 4:
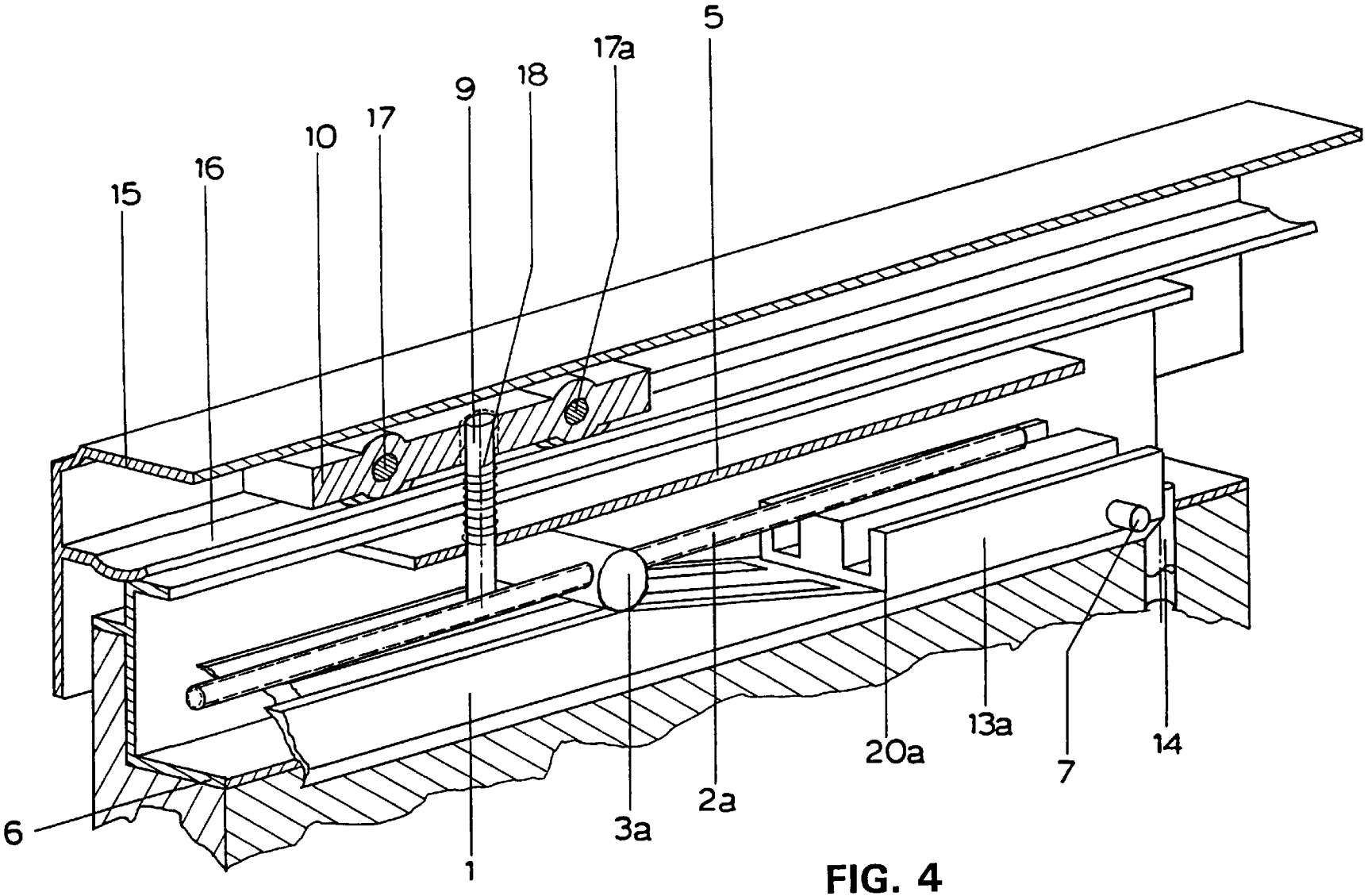
FIG. 4 is a longitudinal cross-sectional view of the rear part of the suspension mechanism, in its uppermost operating position.
Figure 5:
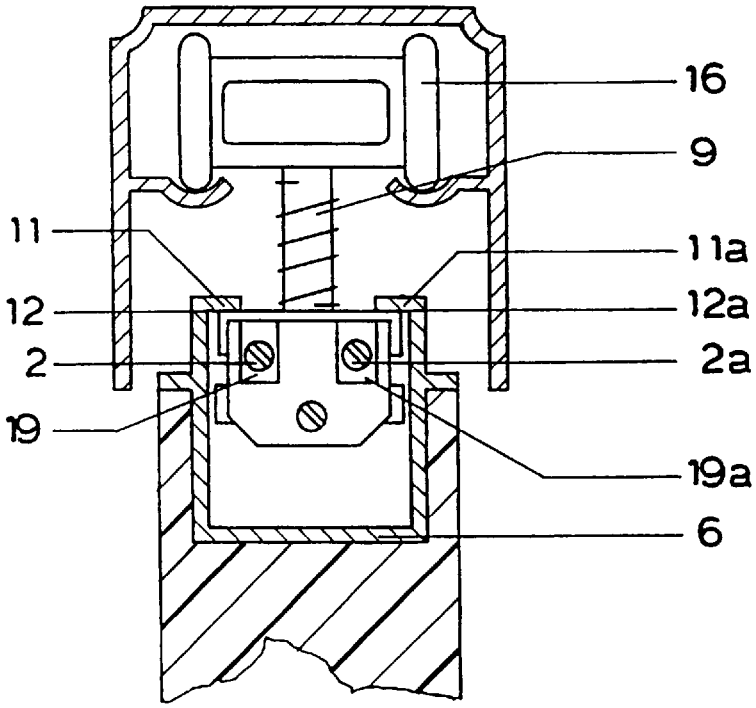
FIG. 5 is a cross-sectional view of the suspension mechanism, in its lowermost operating position.
Figure 6:
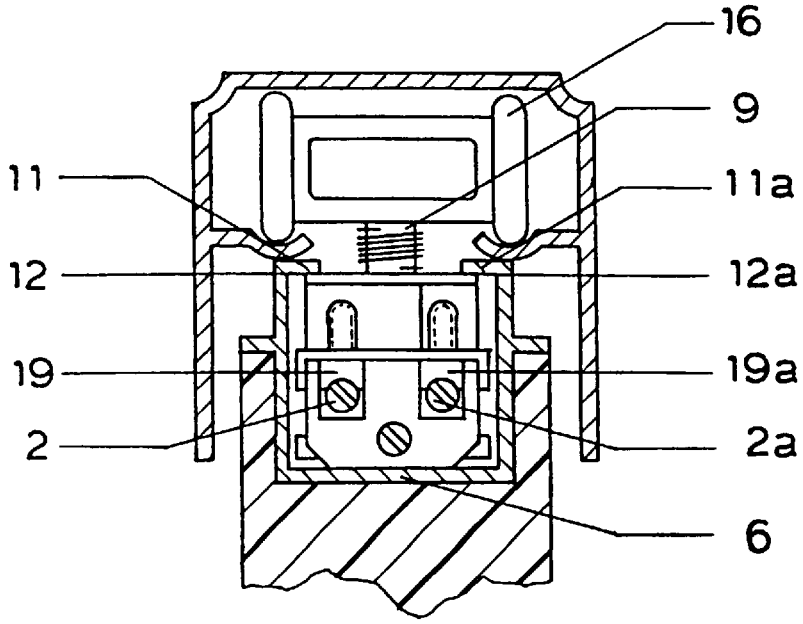
FIG. 6 is a cross-sectional view of the suspension mechanism, in its uppermost operating position.

The drawings illustrate a suspension mechanism for sliding doors with a height and inclination adjusting mechanism basically consisting of a mechanism support (1), a short screw (2), a long screw (2*a*), two cylinders (3, 3*a*), which have each a taphole perpendicular with respect to its longitudinal axis, a spring steel plate (4), which limits the movement of the screws (2, 2*a*), a clamping metal plate (5) of the mechanism support (1) in the section or track (6) of the door, a pin (7), which centers the mechanism support (1) in the section (6) of the door, a centering pin screw (8) which fixes the pin (7), a screw (9) which connects the mechanism support (1) to the wheel support (10).

Based on this invention the mechanism support (1) fits into the section (6) of the door, which is U-shaped.

The two open ends (11, 11*a*) of the section (6) form at the end two corners (12, 12*a*), into which extends the mechanism support (1).

The section (6) of the door can either be an independent part, which is fastened on the upper edge of the door, or the upper part of the door is manufactured such that the door already houses this section.

Blocking pins (14) are mounted on the door, namely where the two ends of the mechanism support (1) end, which blocking pins prevent the mechanism support (1) from running out of the track (6) of the door.

In order to permit the door to move parallel with respect to the door frame, wheels (16, 16*a*) are mounted, which roll on the section (15) of the door frame.

These wheels (16, 16*a*) are connected to one another by the wheel support (10).

Each wheel (16, 16*a*) is connected to the support (10) by means of an axis or axle (17, 17*a*).

The upper end of the connecting screw (9) is screwed to the wheel support (10).

The lower part of the connecting screw (9) is fitted into the mechanism support (1), thus the connecting screw (9) creates the connection between wheel support (10) and mechanism support (1).

The connecting screw (9) is surrounded by a pressure spring (18).

The clamping metal plate (5) is mounted on the upper part of the mechanism support (1), under which plate the cylinders (3, 3*a*) slide.

The pressure spring (18) presses the clamping metal plate (5) so that the plate is always under tension and in contact with the cylinders (3, 3*a*).

Two notches (19, 19*a*) exist along the mechanism support (1), into which notches the short screw (2) and the long screw (2*a*) are placed.

The mechanism support (1) houses an acute recess (20, 20*a*) at its ends (13), in which recess is stored each one cylinder (3, 3*a*).

The screws (2, 2*a*) extend through the cylinders (3, 3*a*).

The spring steel plate (4) is mounted on the front end (13) of the mechanism support (1), which plate limits the two screws (2, 2*a*).

The spring steel plate (4) has two U-shaped recesses, which limit the screws (2, 2*a*) in such a manner that when the screws rotate about their own axis, they are unable to move longitudinally.

While the screw (2, 2*a*) rotates about its own axis, the screw causes a movement of the respective cylinder (3, 3*a*), through the body of the cylinder, and the cylinders (3, 3*a*) are in this manner pulled or pushed accordingly.

While the cylinders (3, 3*a*) are moved in opposite directions of one another toward the center of the mechanism support (1), they press the metal plate (5), which then presses the pressure spring (18) thus reducing the height of the connecting screw (9) and the door is lifted relative to the floor.

In particular if one rotates the short screw (2) from the right to the left, the cylinder (3) moves then toward the center of the mechanism support (1).

While the cylinder (3) slides on the acute recess (20), the front part of the metal plate (5) lifts up, and thus only the front part of the door lifts up.

In the reverse case when one rotates the long screw (2*a*) from the left to the right, the cylinder (3*a*) moves toward the center of the mechanism support (1), and while the cylinder (3*a*) slides on the acute recess (20*a*), and the rear part of the metal plate (5) is lifted, which results in a lifting of the rear part of the door.

What is claimed is:

1. A suspension system for sliding doors with a height and inclination adjusting mechanism comprising a mechanism support fitted in an opening a section of the door, a short screw, a long screw, two cylinders each with taphole extending perpendicularly with respect to a longitudinal axis of the respective cylinder, each taphole receiving one of the short screw and the long screw, a spring steel plate adjacent the mechanism support for limiting longitudinal movement of the short and long screws, a clamping metal plate of the mechanism support in the section of the door, a centering pin of the mechanism support in the section of the door, a centering pin screw of the centering pin laterally securing the mechanism support in the section of the door, a connecting screw of the mechanism support and a wheel support, wherein the mechanism support is surrounded by the opening in the section of the door and is fitted in the section, the section having a U-shape, the connecting screw comprising a connecting piece between the mechanism support and the wheel support, and a pressure spring surrounding the connecting piece.

2. The suspension system for sliding doors as claimed in claim 1, wherein two free ends of the section form two corners, into which extends the mechanism support.

3. The suspension system for sliding doors as claimed in claim 2, wherein the section of the door either comprises an independent part, which is fastened on an upper edge of the door, or the upper edge of the door is manufactured such that the door already houses this section.

4. The suspension system for sliding doors as claimed in claim 1, wherein the section of the door either comprises an independent part, which is fastened on an upper edge of the door, or the upper edge of the door is manufactured such that the door already houses this section.

5. The suspension system for sliding doors claimed in claim 4, wherein even if the door is suspended on a doorframe, the inclination adjusting mechanism is capable of adjusting the door to every desired height and inclination without unhooking the door from the doorframe.

6. The suspension system for sliding doors as claimed in claim 1, wherein the mechanism support is prevented from running out of the section of the door by the two blocking pins, which are mounted on the two ends of the section.

7. The suspension system for sliding doors as claimed in claim 1, wherein an upper end of the connecting screw is screwed into the wheel support, and a lower end is fitted into the mechanism support.

8. The suspension system for sliding doors as claimed in claim 7, wherein the pressure spring of the connecting screw presses onto the clamping metal plate so that the clamping metal plate is under constant tension and in contact with the cylinders sliding underneath the clamping metal plate.

9. The suspension system for sliding doors as claimed in claim 7, wherein when the cylinders move toward a center of the mechanism support, the cylinders both press onto the clamping metal plate, the clamping metal plate thereafter pressing against the pressure spring and thus reducing the height of the connecting screw and lifting the door relative to a floor.

10. The suspension system for sliding doors as claimed in claim 7, wherein the inclination adjustment mechanism is capable of simultaneous adjustment to respective desired heights at front and rear sides of the door.

11. The suspension system for sliding doors as claimed in claim 1, wherein the pressure spring of the connecting screw presses onto the clamping metal plate so that the clamping metal plate is under constant tension and in contact with the cylinders sliding underneath the clamping metal plate.

12. The suspension system for sliding doors as claimed in claim 1, wherein rotation of the short and long screws push or pull the cylinders toward or away from a center of the mechanism support.

13. The suspension system for sliding doors as claimed in claim 1, wherein when the cylinders move toward a center of the mechanism support, the cylinders both press onto the clamping metal plate, the clamping metal plate thereafter pressing against the pressure spring, and thus reducing the height of the connecting screw relative to the clamping metal plate and lifting the door relative to a floor.

14. The suspension system for sliding doors as claimed in claim 1, wherein when one rotates the short screw from the right to the left, one of the cylinders moves toward a center of the mechanism support and slides on an acute recess, and a front part of the clamping metal plate lifts up and consequently only a front part of the door lifts up, in a reverse instance, when one rotates the long screw from the left to the right, the other one of the cylinders moves toward the center of the mechanism support and slides on a second acute recess, lifting a rear part of the clamping metal plate which results in a lifting of a rear part of the door.

15. The suspension system for sliding doors as claimed in claim 1, wherein the inclination adjusting mechanism is capable of simultaneous adjustment in an operating process which simultaneously adjusts respective desired heights at front and rear sides of the door.

16. The suspension system for sliding doors as claimed in claim 1, wherein even if the door is suspended on a door frame, the inclination adjusting mechanism is capable of adjusting the door to every desired height and inclination without unhooking the door from the door frame.

17. A suspension system for a sliding door on a doorframe and having a height and inclination adjusting mechanism comprising:

a wheel support for movably mounting on the doorframe, the wheel support including wheels supported thereby;

a connecting screw between the wheel support and a mechanism support;

the mechanism support fitting in and surrounded by an opening in a door having a section with a U-shape;

a clamping metal plate in the section of the door;

two spaced cylinders adjacent the mechanical support and the clamping metal plate;

a pressure spring about the connecting screw so that one side of the clamping metal plate is under constant tension from the pressure spring and the other side of the clamping metal plate is in constant contact with the cylinders;

a short screw connected to a first one of the cylinders;

a long screw connected to a second one of the cylinders; and a spring steel plate adjacent the mechanism support for limiting longitudinal movement of the short and long screws.

18. The suspension system of claim 17, wherein rotation of one of the short and long screws moves one of the cylinders toward or away from a center of the mechanism support.

19. The suspension system of claim 18, wherein the cylinders slide on respective acute recesses, movement along the recesses increasing or decreasing the height of the connecting screw relative to the clamping metal plate and lifting the door relative to the floor.

20. The suspension system of claim 18, wherein the inclination adjusting mechanism is capable of adjusting the door to every desired height and inclination without unhooking the door from the doorframe.

21. The suspension system of claim 17, wherein rotation of the short screw in a first direction slides one of the cylinders toward a center of the mechanism support along an acute recess such that the cylinder presses onto the clamping metal plate which applies force toward the pressure spring such that a front part of the clamping metal plate thereby lifts up a front part of the door, and in a reverse instance, rotation of the long screw in an the opposite direction slides the other one of the cylinders toward the center of the mechanism support along another acute recess such that the other cylinder presses onto the clamping metal plate which applies force toward the pressure spring such that a rear part of the clamping metal plate thereby lifts up a rear part of the door.

22. The suspension system of claim 17, wherein the connecting screw comprises a connecting piece between the mechanism support and the wheel support.

23. The suspension system of claim 17, wherein blocking pins mounted on ends of the section of the door prevent removal or movement of the mechanism support with respect to the door section.

24. The suspension system of claim 17, including a centering pin laterally fixing the mechanism support in the section of the door; and a centering pin screw fixing the centering pin relative to the mechanism support.

* * * * *